US011319652B2

(12) United States Patent
Carol

(10) Patent No.: US 11,319,652 B2
(45) Date of Patent: May 3, 2022

(54) PORTABLE HANGING KNITTING NEEDLE AND ACCESSORY HOLDER

(76) Inventor: Paula Carol, Huntington, NY (US)

( * ) Notice: Subject to any disclaimer, the term of this patent is extended or adjusted under 35 U.S.C. 154(b) by 0 days.

(21) Appl. No.: 12/796,399

(22) Filed: Jun. 8, 2010

(65) Prior Publication Data

US 2011/0297569 A1 Dec. 8, 2011

(51) Int. Cl.
*B65D 85/24* (2006.01)
*D04B 3/06* (2006.01)

(52) U.S. Cl.
CPC ..... *D04B 3/06* (2013.01); *B65D 85/24* (2013.01)

(58) Field of Classification Search
CPC ..... B65D 85/24; D04B 3/06
USPC ..... 206/383, 373, 372, 278; 383/38, 39
See application file for complete search history.

(56) References Cited

U.S. PATENT DOCUMENTS 962,595 A * 6/1910 Smith ..... 211/88.01
1,437,349 A * 11/1922 Moore, Jr. ..... A63B 55/40 206/315.6
1,447,636 A * 3/1923 White ..... A47G 25/08 248/301
1,495,220 A * 5/1924 Carroll ..... A45C 3/00 383/39
2,532,517 A * 12/1950 Schwartzman et al. ..... 383/39
3,120,297 A * 2/1964 Riley ..... A45C 7/0095 190/110
3,181,751 A * 5/1965 Wilson ..... A01K 97/06 383/39
3,967,666 A * 7/1976 Farrar ..... A61G 7/0503 383/7
4,401,219 A * 8/1983 Mink ..... 206/566
D300,399 S * 3/1989 Krugman ..... D6/553
4,901,899 A * 2/1990 Barrett ..... 224/223
4,949,843 A * 8/1990 Stokes ..... 206/305
4,960,204 A * 10/1990 Young et al. ..... 206/235
D313,524 S * 1/1991 Barnes ..... D6/553
D332,697 S * 1/1993 Schildkraut ..... D3/303
5,209,344 A * 5/1993 Smith ..... 206/6.1
5,337,907 A * 8/1994 McKenzie et al. ..... 211/88.01
D364,520 S * 11/1995 Matthews ..... D6/514
5,813,539 A * 9/1998 DePalma ..... 206/459.1
6,000,509 A * 12/1999 Chisholm ..... A45C 13/02 150/113
D429,897 S * 8/2000 Rogman et al. ..... D6/320
D453,428 S * 2/2002 Beer ..... D6/407
6,467,613 B2 * 10/2002 Felsenthal ..... 206/213
6,505,638 B1 * 1/2003 Powell ..... E04H 15/18 135/115
D478,234 S * 8/2003 Beer ..... D6/571
D500,919 S * 1/2005 MacKay ..... D3/20
6,959,806 B2 * 11/2005 Barker ..... 206/6.1
7,264,127 B2 * 9/2007 Jones ..... A47J 47/16 206/320
D595,918 S * 7/2009 Walter ..... D34/27

* cited by examiner

*Primary Examiner* — Steven A. Reynolds
(74) *Attorney, Agent, or Firm* — John F. Vodopia PC

(57) ABSTRACT

A storage device may be portable and may be configured to be hung on a wall or a door, for example. The storage device may include a plurality of pockets made of a transparent or translucent material through which a user may see the items stored in the pockets. The pockets may be formed in various sizes suitable for holding knitting needles and accessories.

9 Claims, 3 Drawing Sheets

PORTABLE HANGING KNITTING NEEDLE AND ACCESSORY HOLDER

BACKGROUND OF THE INVENTION

The present invention relates to storage devices and, more particularly, to a portable storage device for holding knitting needles and related accessories.

Seasoned knitters often face a problem with clutter in the storage and retrieval of knitting needles and supplies. Knitters have many varying sizes of needles which may be difficult to find when needed. Conventional storage devices may not allow the user to view all of their knitting tools in one area without looking into various containers or separate storage bags.

As can be seen, there is a need for an apparatus for organizing and storing knitting needles and supplies.

SUMMARY OF THE INVENTION

In one aspect of the present invention, a storage device comprises multiple rows of pockets including at least a first row of elongated pockets and a first row of large pockets; a plurality of grommets located along a top edge of the storage device, wherein the elongated pockets and the large pockets are transparent or translucent, allowing a user to see the items stored within the pockets.

In another aspect of the present invention, a storage device comprises multiple rows of transparent pockets including at least a first row of elongated pockets, a second row of elongated pockets positioned below the first row of elongated pockets, and a first row of large pockets positioned below the second row of elongated pockets; and a plurality of grommets located along a top edge of the storage device, wherein the elongated pockets and the large pockets are transparent or translucent, allowing a user to see the items stored within the pockets; the first row of elongated pockets and the second row of elongated pockets each include from about 8 to about 10 pockets; the first row of elongated pockets and the second row of elongated pockets are independently from about 1 to 3 inches wide and from about 16 to about 20 inches high; and the first row of large pockets include three equally sized pockets.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a storage device that may be portable and may be configured to be hung on a wall or a door, for example. The storage device may include a plurality of pockets made of a transparent or translucent material through which a user may see the items stored in the pockets. The pockets may be formed in various sizes suitable for holding knitting needles and accessories. By displaying individual knitting needles in the pockets, a person can easily eye his or her needles and accessories and keep all of the items in one place for handy access.

Figure 1:
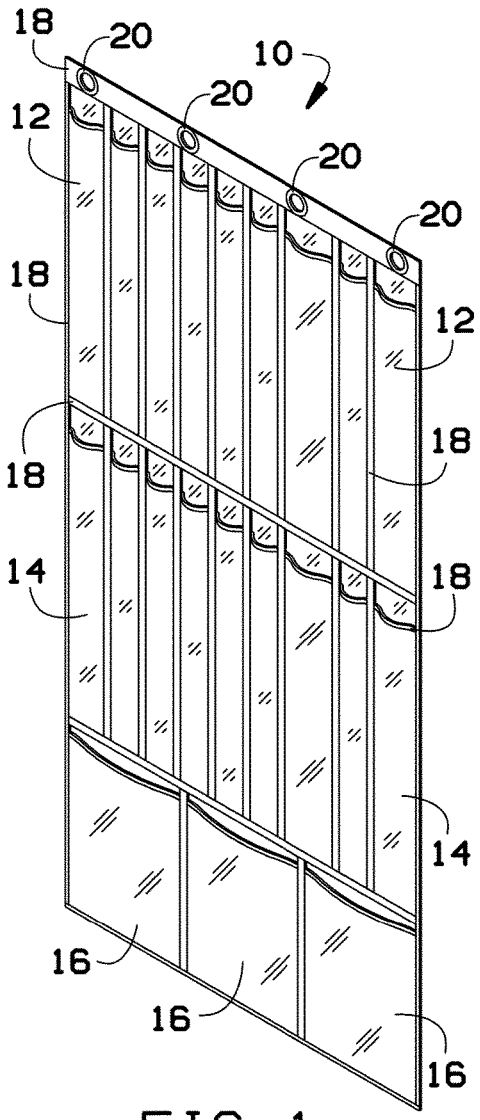
FIG. 1 is a perspective view of a storage device according to an embodiment of the present invention.
Figure 2:
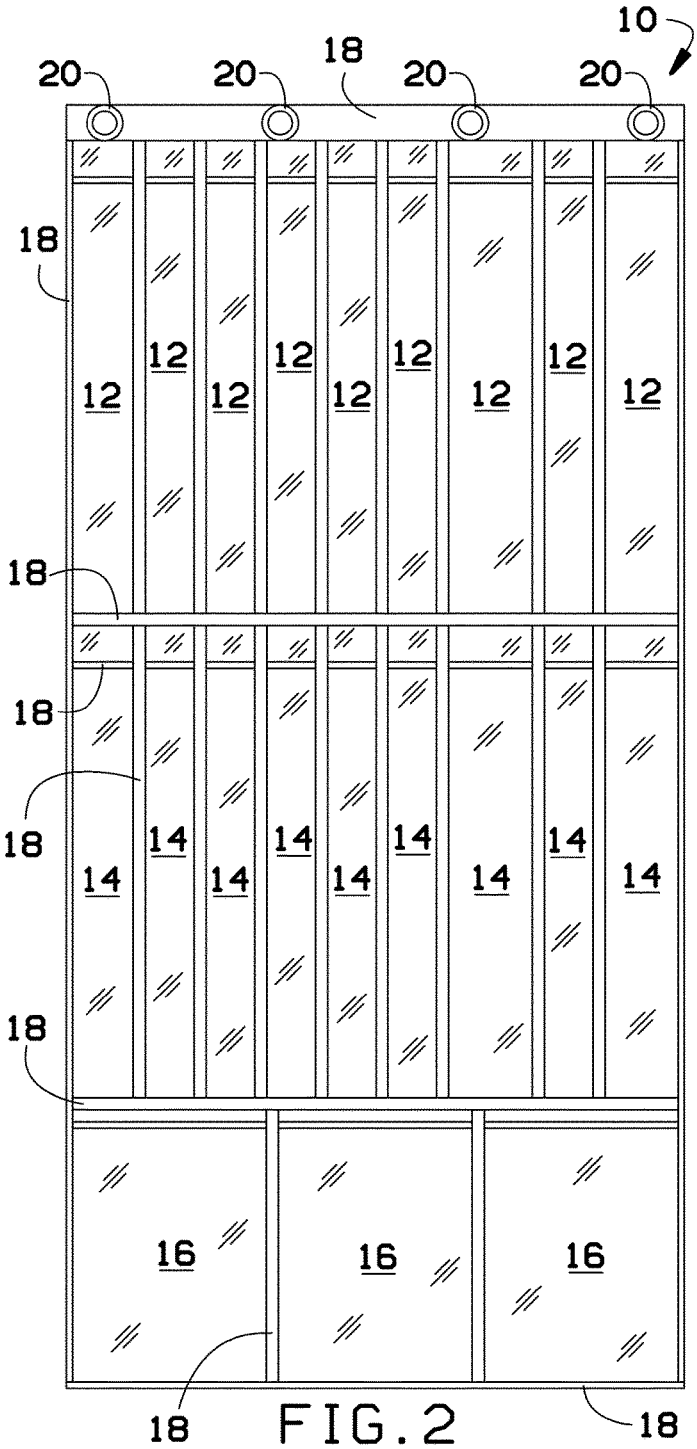
FIG. 2 is a front view of the storage device of FIG. 1.
Figure 3:
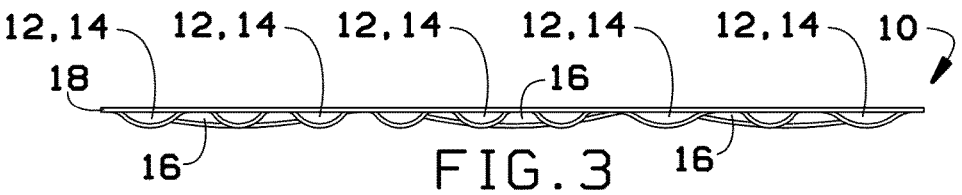
FIG. 3 is a top view of the storage device of FIG. 1.
Figure 5:
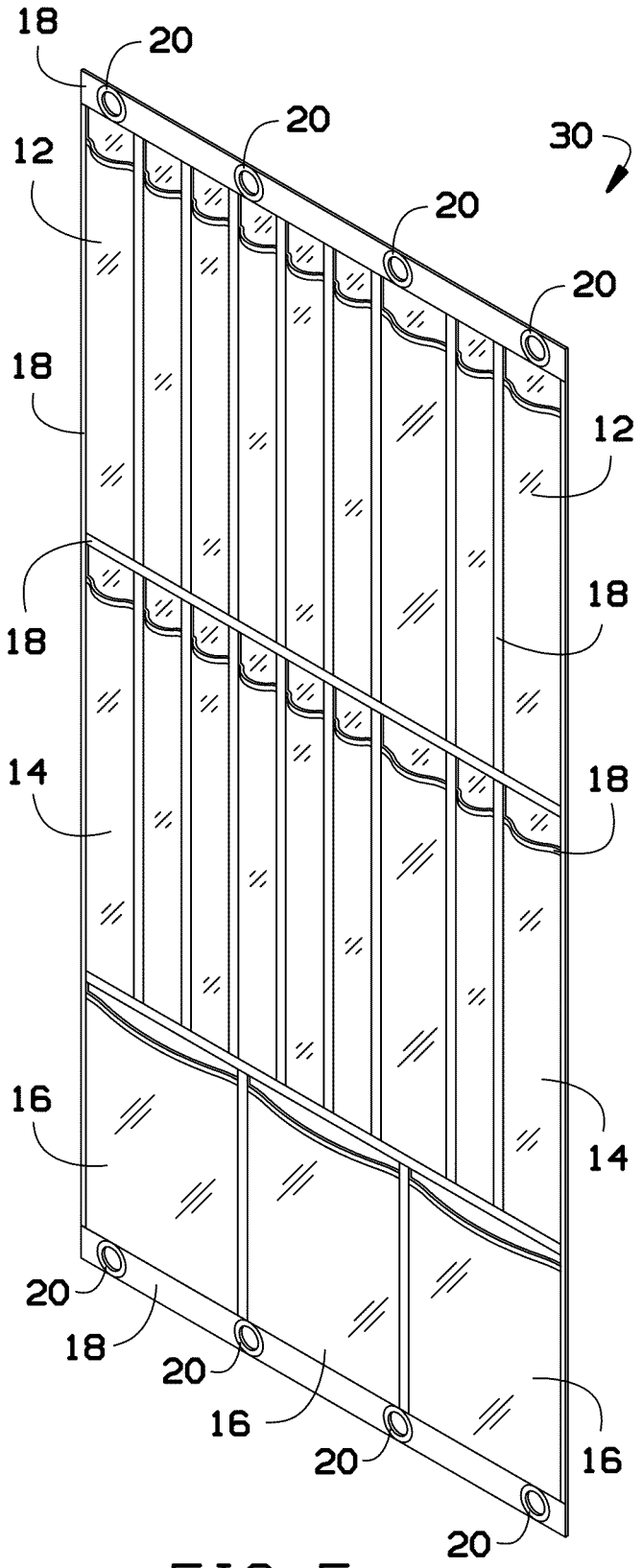
FIG. 5 is a perspective view of the storage device of FIG. 1 with the addition of bottom grommets, according to an embodiment of the present invention.

Referring to FIGS. 1 through 3, a storage device 10 may include a plurality of pockets 12, 14, 16 formed of a transparent or a translucent material. The material may be, for example, a clear heavy duty vinyl. The pockets 12, 14, 16 may be separated by a trim 18. The trim 18 may be, for example, black, clear or a variety of colors. A plurality of grommets 20 may be installed at one end of the storage device 10. For example, four two-inch grommets 20 may be equally spaced about the top edge of the storage device 10. The grommets 20 may be used for easy installation of the storage device 10 and may allow for portability of the storage device 10. In an alternate embodiment, over-the-door hooks may be either attached directly to the storage device 10, or may be used to provide a hook for the grommets 20. In a further alternate embodiment of the present invention as shown in FIG. 5, in a storage device 30, grommets 20 may be disposed along a bottom edge of the storage device. The bottom grommets may help secure the storage device to a door, for example, to prevent the bottom of the storage device from swing away from the door as the door is opened or closed.

The storage device 10 may be from about 20 to about 30 inches wide, typically about 24-26 inches wide. The storage device 10 may be from about 45 to about 60 inches high, typically about 52-54 inches high.

In one embodiment of the present invention, a first row of pockets 12 and a second row of pockets 14 (elongated pockets 12, 14) each may include from about 5 to about 15 pockets, typically about 8 to about 10 pockets. The pockets 12, 14 may have depths from about 14 to about 24 inches, typically from about 16 to about 20 inches. The pockets 12, 14 may have various widths, ranging, for example, from about 1 inch to about 3 inches, typically from about 1⅜ inch to about 2⅜ inch. The pockets 12 may be separated from the pockets 14 by about one inch.

A third row of pockets 16 (large pockets 16) may be formed along the bottom of the storage device 10. The third row of pockets 16 may be formed from about 7 to about 9 inches wide and from about 10 to about 12 inches high. In one embodiment, the third row of pockets 16 may include three equal sized pockets 16. Similar to the other pockets 12, 14, the pockets 16 may be formed from a transparent or translucent material, such as a clear vinyl material. The pockets 16 may be separated from the pockets 14 by about one inch.

The rows of pockets 12, 14, 16 may be arranged in various positions. For example, the row of pockets 12 may be located at the top of the storage device 10, the row of pockets 16 may be located below the row of pockets 12, and the row of pockets 14 may be located below the row of pockets 16.

Figure 4:
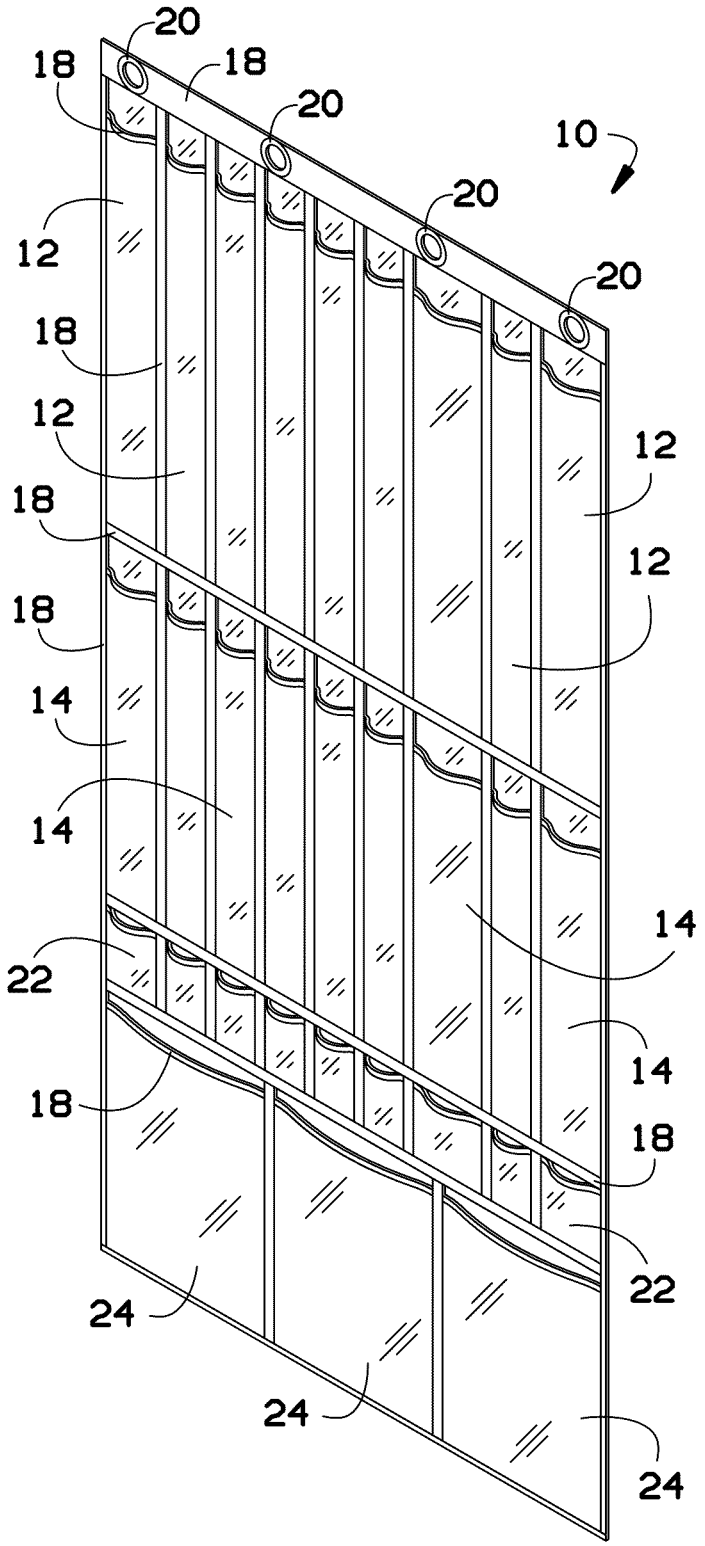
FIG. 4 is a perspective view of a storage device according to an alternate embodiment of the present invention.

In an alternate embodiment of the present invention, as shown in FIG. 4, a fourth row of pockets 22 may be formed in the storage device 10. This fourth row of pockets 22 may be formed smaller than the other pockets 12, 14, 16 for storing small craft items. For example, the row of pockets 22 may include from about 8 to about 12 pockets, each pocket having a width between about 1 to about 3 inches and a height from about 2 to about 4 inches. In one embodiment of the present invention, the widths of the pockets 22 in the row of pockets 22 may match the widths of the below and/or above adjacent row of pockets 22. The row of pockets 22 may be situated between any of the above described rows of pockets 12, 14, 16. As shown in FIG. 4, the row of pockets 22 may be situated between the row of pockets 14 and a row of large pockets 24.

It should be understood, of course, that the foregoing relates to exemplary embodiments of the invention and that modifications may be made without departing from the spirit and scope of the invention as set forth in the following claims.

What is claimed is:

1. A storage device for storing and displaying knitting supplies, consisting essentially of:

multiple rows of pockets including at least a first row of elongated pockets for storing and displaying knitting needles and a first row of large pockets for storing and displaying knitting materials; and a plurality of grommets arranged in an edge trim located along a top edge and an edge trim located along a bottom edge of the storage device providing capabilities to easily install and to secure the storage device, respectively;

wherein the elongated pockets and the large pockets are transparent or translucent, allowing a user to see the knitting needles and/or knitting materials stored within the elongated pockets and large pockets, respectively, and wherein the elongated pockets are from about 1.4 times to about 2.4 times deeper than the large pockets and include a pocket trim located at an exterior edge of a material forming each elongated pocket providing a capability to support knitting needles stored and displayed therein.

2. The storage device of claim 1, further comprising a second row of elongated pockets positioned below the first row of elongated pockets.

3. The storage device of claim 2, wherein the first row of elongated pockets and the second row of elongated pockets each include from about 8 to about 10 pockets.

4. The storage device of claim 1, wherein the first row of elongated pockets are from about 1 to 3 inches wide and from about 16 to about 20 inches high.

5. The storage device of claim 1, wherein the first row of large pockets includes three equally sized pockets.

6. The storage device of claim 1, wherein the plurality of grommets includes four grommets equally spaced along the top edge of the storage device.

7. The storage device of claim 1, further comprising trim around exterior edges of the large pockets.

8. The storage device of claim 1, further comprising a first row of small pockets, wherein the small pockets are transparent or translucent, allowing a user to see the items stored within the pockets.

9. A storage device for storing and displaying knitting supplies, consisting essentially of:

multiple rows of transparent pockets including at least a first row of elongated pockets for storing and displaying knitting needles, a second row of elongated pockets for storing and displaying knitting needles positioned below the first row of elongated pockets, and a first row of large pockets for storing and displaying knitting materials positioned below the second row of elongated pockets;

a top edge and a bottom edge of the storage device formed with top and bottom device trims comprising a trim material; and a plurality of grommets located along the top and bottom device trims comprising the top edge and the bottom edge of the storage device providing capabilities to easily install and to secure the storage device, respectively;

wherein the elongated pockets and the large pockets are transparent or translucent, allowing a user to see the knitting needles and/or knitting materials stored within the elongated and large pockets;

wherein the first row of elongated pockets and the second row of elongated pockets each include from about 8 to about 10 elongated pockets;

wherein each of the elongated pockets is configured with a pocket edge trim on an exterior edge of a transparent or translucent material forming the elongated pockets providing a capability to support knitting needles stored and displayed therein;

wherein the first row of elongated pockets and the second row of elongated pockets are independently from about 1 to 3 inches wide and from about 16 to about 20 inches high; and wherein the first row of large pockets includes three equally sized pockets.

* * * * *